US006575381B1

(12) United States Patent
Fujiwara

(10) Patent No.: US 6,575,381 B1
(45) Date of Patent: Jun. 10, 2003

(54) ARTIFICIAL SNOW PRODUCING AND RELEASING APPARATUS AND METHOD THEREOF

(75) Inventor: Takamasa Fujiwara, Hiroshima (JP)

(73) Assignee: Kabushiki Kaisha Piste Snow Industries, Tokyo (JP)

( * ) Notice: Subject to any disclaimer, the term of this patent is extended or adjusted under 35 U.S.C. 154(b) by 48 days.

(21) Appl. No.: 09/501,641

(22) Filed: Feb. 11, 2000

(30) Foreign Application Priority Data

Aug. 4, 1999 (JP) ..... 11-220957

(51) Int. Cl.[7] ..... F25C 3/04

(52) U.S. Cl. ..... 239/2.2; 239/2.1; 239/14.1; 239/14.2; 239/DIG. 21; 241/DIG. 17

(58) Field of Search ..... 239/2.1, 2.2, 14.1, 239/DIG. 21; 241/185.6, DIG. 17

(56) References Cited

U.S. PATENT DOCUMENTS 1,782,296 A * 11/1930 Goldstein ..... 241/DIG. 17 X
2,114,557 A * 4/1938 Davis ..... 241/DIG. 17 X
2,136,214 A * 11/1938 Keith ..... 241/DIG. 17 X
2,234,425 A * 3/1941 Brady ..... 241/DIG. 17 X
2,322,306 A * 6/1943 McLaren ..... 241/DIG. 17 X
2,609,992 A * 9/1952 Matthews ..... 241/DIG. 17 X
3,096,718 A * 7/1963 Anderson ..... 241/185.6 X

FOREIGN PATENT DOCUMENTS

JP 6-051122 2/1994
JP 6-051122 9/1995

* cited by examiner

*Primary Examiner*—Robin O. Evans
(74) *Attorney, Agent, or Firm*—Omori & Yaguchi USA, LLC

(57) ABSTRACT

Primarily crushed flaky or platy pieces of ice are supplied from a supply port into a rotary blade casing of a high speed rotary snow producing and throwing apparatus toward a rotor blade in the shaft direction of a rotating shaft by strong discharge pressure of a forced blast, crushed into pieces with smaller and finer particle size through second crushing by the rotor blade rotating at high speed, and sent out from a delivery port nearly in the direction of a tangent of the rotational outer periphery of the rotor blade.

14 Claims, 4 Drawing Sheets

PRIOR ART

ARTIFICIAL SNOW PRODUCING AND RELEASING APPARATUS AND METHOD THEREOF

BACKGROUND OF THE INVENTION

1. Field of the Invention

The present invention relates to an apparatus and a method used for an artificial skiing ground, for example, and particularly relates to an artificial snow producing and releasing apparatus for crushing flaky or platy pieces of ice produced by primary crushing into smaller snowflaky pieces of ice and releasing it far away, and the method thereof.

2. Description of the Related Art

A prior artificial snow producing and releasing apparatus is an apparatus for producing artificial snow by crushing lumps of ice by means of a blast-type crusher such as an ice crusher into finer snow mingled with ice and releasing it.

An apparatus shown in FIG. 7, for example, has a structure in which a rotor blade 34 for crushing is provided inside a casing 33 provided on a base 36 and the rotor blade 34 is covered with the casing 33. A supply port serving both as a blast port 30 from which a blast for blowing artificial snow 38 away is supplied and a supply port 31 from which lumps of ice which are raw materials are supplied is provided at one end on the base 36 at the lower end of the casing 33, and a discharge port 32 from which the artificial snow 38 composed of crushed ice is blown away is provided at the other end on the base 36 at the lower end of the casing 33 on the opposite side to the supply port 31. Lumps of ice 37 supplied together with a blast from the blast port 30 on the base on the right side of FIG. 7 are beaten against the base 36 by the rotor blade 34 rotating at high speed in the casing 33 and crushed into snow mingled with ice to make the artificial snow 38, and subsequently the artificial snow 38 is blown away to a skiing slope from the discharge port 32 by the blast and sprinkled over the slope.

In another type of blast-type crusher shown in FIG. 8, a supply port 41 from which lumps of ice are supplied and a blast port 40 from which a blast for delivery is supplied are provided at separate positions of a casing 43 of the blast-type crusher, and the supply port 41 for lumps of ice 47 is provided in the upper portion of the casing 43. While the lumps of ice supplied from the supply port 41 are rotationally forwarded by a rotor blade 44 for crushing which rotates at high speed by means of a rotating shaft 45, the lumps of ice are beaten and crushed by the rotor blade 44 and sent to the blast port 40 at the lower end of the casing, and further finely smashed against the base 46 by the rotor blade 44 into snow mingled with ice to make artificial snow 48, and discharged from a discharge port 42 on the opposite side at the lower end of the casing 43 and blown away by a blast.

Japanese Patent Laid-open No. Shou 62-182567 discloses an apparatus for shaving the tip of a large lump of ice into with a rotary cutter crusher to produce artificial snow composed of snow mingled with ice while moving the lump of ice forward by a conveyor, sending the artificial snow to a rotary snow throwing machine with a built-in impeller at the back, delivering it into a cylinder by the rotation of the centrifugal impeller, and further adding air from an air jet port to the delivered artificial snow within the cylinder to throw the artificial snow from within the cylinder, or instead of providing the air jet port within the cylinder and adding air to throw the artificial snow from within the cylinder, sucking in air from the opposite side to an artificial snow suction port with the impeller as a double suction type centrifuge to throw the artificial snow from within the cylinder.

These prior blast-type crushers have the following disadvantages.

In the crusher shown in FIG. 7, unevenness occurs in the size of particles of ice crushed by the rotor blade 34 due to variation in the supply quantity of the lumps of ice 37 to be supplied to the casing 33 from the blast port 30. Further, when the supply of the lumps of ice 37 is excessive, there is the possibility that a space between the blast port 30 and the discharge port 32 is blocked, and thus more power than necessary is required in order to rotate the rotor blade 34 at high speed.

In the blast-type crusher shown in FIG. 8, in addition to the disadvantage of the aforesaid blast-type crusher shown in FIG. 7, when the blast power at the blast port 40 is raised in order to release crushed ice far away, not all the blast power inside the casing 43 flows to the discharge port 42, but part of the blast power also flows backward to the supply port 41 side and leaks out from the supply port 41, and hence the blast power necessary for releasing the artificial snow 48 composed of crushed ice from the discharge port 42 reduces. As a result, the artificial snow 48 can not be released far away, thereby requiring still more power than necessary.

In the apparatus disclosed in Japanese Patent Laid-open No. Shou 62-182567, the front face of the large lump of ice is shaved with the rotary cutter crusher to make artificial snow composed of snow mingled with ice while being moved forward by a conveyor. The apparatus, however, is extremely large-sized, and the producing capacity thereof is inferior in efficiency to that of the aforesaid apparatus in which the pieces of ice are beaten by the rotor blade and the base. The obtained artificial snow is supplied to the rotary snow throwing machine by sending the artificial snow flying by only mechanical force of the rotary cutter. Consequently, a large quantity of artificial snow can not be supplied, and therefore supply efficiency is low. Accordingly, even if the artificial snow is sent into a chute used for letting snow fall in the rotary snow throwing machine by centrifugal force of the impeller, air needs to be further jetted halfway in the chute. In the apparatus in which the double suction type rotary snow throwing machine is used in place of the aforesaid rotary snow throwing machine, air sucked into the double suction type rotary snow throwing machine from an opening on the opposite side to the side of the supply port for the artificial snow is sent into the chute, with the disadvantage that a large quantity of artificial snow can not be supplied by sending it flying with the rotary cutter left unsolved. Therefore, delivery power necessary for delivering the artificial snow and air into the chute needs to be given to the double suction type rotary snow throwing machine itself, which is a burden for the double suction type rotary snow throwing machine itself, thus requiring large increase in size of the machine. Consequently, there arises a disadvantage that the apparatus becomes still larger in size combined with the aforesaid increase in size of the rotary cutter crusher. Further, in the apparatus disclosed in Japanese Patent Laid-open No. Shou 62-182567, the artificial snow composed of crushed ice to be supplied to the rotary snow throwing machine is not supplied while being sent by means of air from the beginning, whereby only the artificial snow touches the impeller of the rotary snow throwing machine. Alternatively, in the double suction type rotary snow throwing machine, a partition is provided in the impeller to separate the artificial snow and air so that the artificial snow and air do not abut on the same portion of the impeller. As a result, the artificial snow, that is, flaky pieces of ice adhere to a beating portion of the rotating impeller, which causes the impeller to lose its balance and increases the load. Under a worse situation, an excess current occurs in a drive motor, which requires the stop of operation. Especially, since the flaky piece of ice is scaly ice with a thickness of 2 mm to 3 mm and a size of 100 $mm^2$ and the surface area thereof is large, it has a property of being prone to adhere as compared with another block-shaped ice. Accordingly, hitherto there never exist any appropriate snow producing and throwing apparatus for which flaky pieces of ice are used.

Artificial snow produced and thrown by the prior apparatus is corn snow and not firm snow, and hence in a slope for skiing and the like, it is far behind natural snow in property.

SUMMARY OF THE INVENTION

An object of the present invention is to provide a method of efficiently supplying flaky or platy pieces of ice by primary crushing to a secondary crusher with strong discharge pressure of a forced blast and secondarily crushing the supplied pieces of ice into smaller pieces to produce firm artificial snow suitable for slope skiing and similar to natural snow, and throwing the artificial snow far away by an increase in the discharge pressure of the forced blast in addition to centrifugal force given from a rotor blade, and a compact apparatus for carrying out the method and efficiently producing and throwing a large quantity of artificial snow.

To attain the above object, the main aspect of the present invention is an apparatus for producing artificial snow from flaky or platy pieces of ice and releasing the artificial snow, comprising a rotating shaft, a rotor blade having a plurality of blades disposed along the direction of rotation of the rotating shaft, means for rotationally driving the rotating shaft, a casing enclosing the rotor blade and having a supply port from which the pieces of ice and a forced blast are supplied toward the rotor blade in the shaft direction of the rotating shaft and a delivery port from which the artificial snow produced from the pieces of ice and the forced blast are sent out nearly in the direction of a tangent of the rotational outer periphery of the rotor blade.

These objects and still other objects and advantages of the present invention will become apparent upon reading the following specification when taken in conjunction with the accompanying drawings.

DETAILED DESCRIPTION OF THE PREFERRED EMBODIMENT

Figure 1:
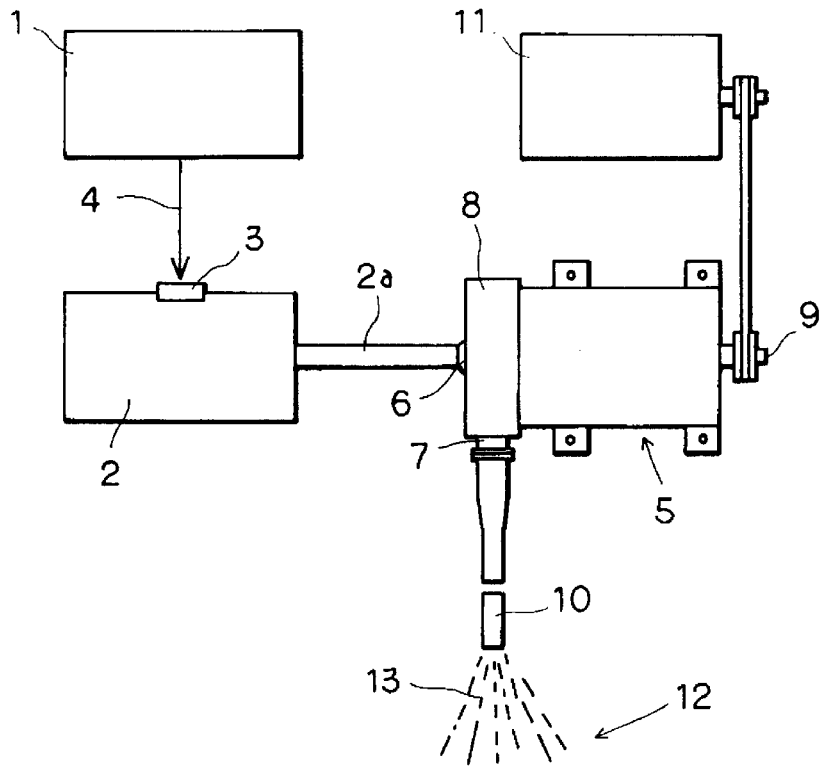
FIG. 1 is a view showing the schematic structure of an artificial snow producing and releasing system according to an embodiment of the present invention.

FIG. 1 is a view showing the schematic structure of an artificial snow producing and releasing system according to an embodiment of the present invention.

Pieces of ice used for the system are primarily crushed platy or flaky pieces of ice. The platy or flaky pieces of ice are produced by means of a primarily crushed pieces of ice producing apparatus 1. Namely, the platy pieces of ice are prepared by producing large plate-shaped ice with a thickness of 7 mm to 8 mm by means of ice making machinery, followed by primarily crushing the large plate-shaped ice, for example, by dropping it, into platy pieces of ice, preferably with the size of about 100 $cm^2 \times 7$ mm to 8 mm. Meanwhile. the flaky pieces of ice are prepared by producing ice on the inner wall of a drum by means of drum-type ice making machinery, followed by shaving the ice by blades into flaky pieces of ice, preferably with the size of about 400 $mm^2 \times 1.5$ mm, by way of primary crushing. The pieces of ice are, however, not limited to the primarily crushed pieces of ice, that is, not limited to the aforesaid type of pieces of ice, but may be produced in any method if the pieces of ice are about the aforesaid size enough to be carried by a forced blast.

The pieces of ice produced by the primarily crushed pieces of ice producing apparatus 1 are brought into a rotary blower 2 from a rotary valve 3 of the rotary blower 2 along an arrow 4 in FIG. 1. The rotary blower 2 supplies the pieces of ice from a supply port 6 of a high speed rotary snow producing and throwing apparatus 5 into a cylindrical rotor blade casing 8 via a pipe 2*a* by a forced blast with a discharge pressure of 0.12 $kgf/cm^2$ to 0.40 $kgf/cm^2$.

Figure 2:
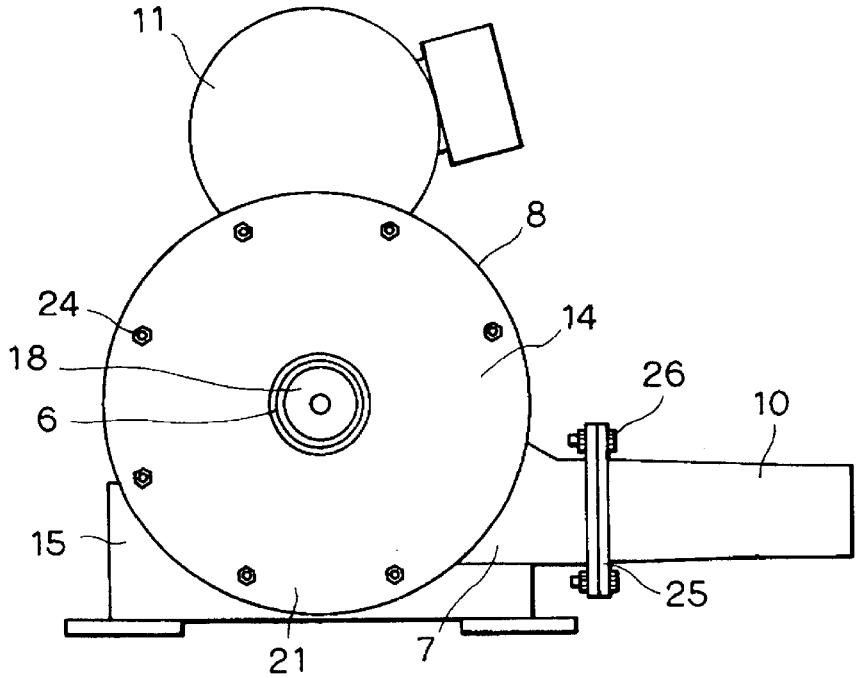
FIG. 2 is a front view of a high speed rotary snow producing and throwing apparatus shown in FIG. 1.
Figure 3:
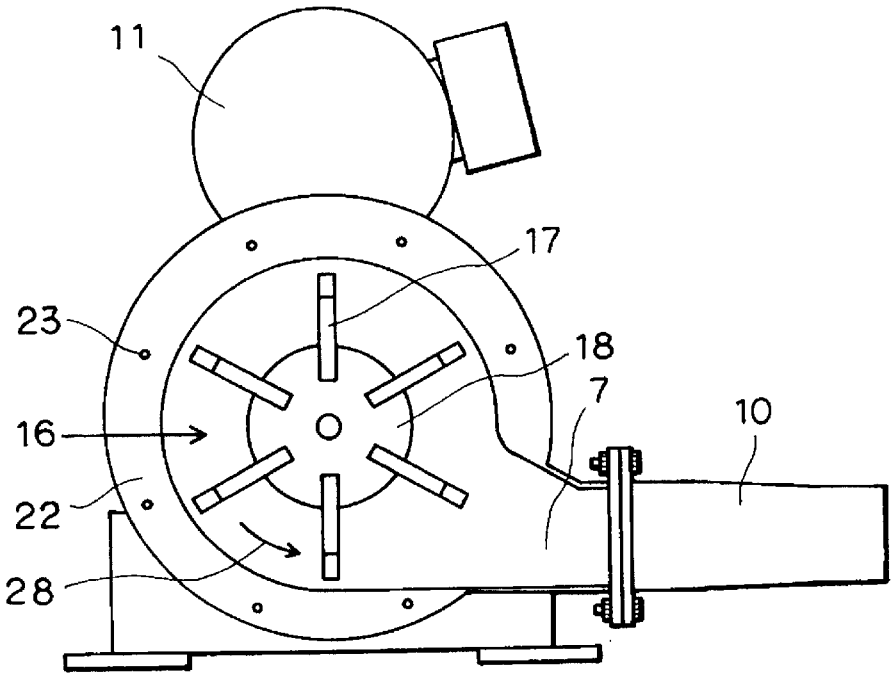
FIG. 3 is a view showing a rotor blade with a lid of a rotor blade casing of the high speed rotary snow producing and throwing apparatus shown in FIG. 2 being taken off.
Figure 4:
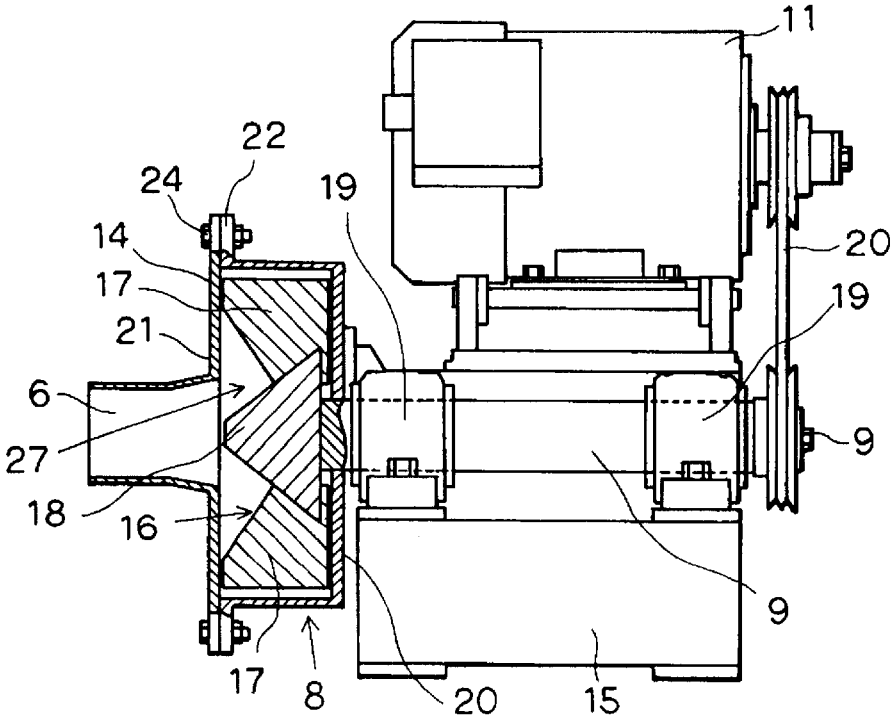
FIG. 4 is a sectional side view showing only the rotor blade casing of the high speed rotary snow producing and throwing apparatus shown in FIG. 2.

FIG. 2 is a front view of the high speed rotary snow producing and throwing apparatus 5, FIG. 3 is a view showing a rotor blade with a lid of the rotor blade casing 14 of the high speed rotary snow producing and throwing apparatus 5 in FIG. 2 being taken off, and FIG. 4 is a cross sectional side view showing only the rotor blade casing of the high speed rotary snow producing and throwing apparatus 5 shown in FIG. 2.

Inside the rotor blade casing 8 in the high speed rotary snow producing and throwing apparatus 5, a plurality of blades, for example, six blades 17 are disposed at even intervals around a conical cover 18 provided at the tip of a rotating shaft 9, thereby composing a rotor blade 16. In the high speed rotary snow producing and throwing apparatus 5, the primarily crushed flaky or platy pieces of ice are secondarily crushed into smaller pieces to produce artificial snow 13. The obtained artificial snow 13 is delivered from a delivery port 7 into a snow throwing hose 10 by centrifugal force given from the rotor blade together with the forced blast.

The rotor blade 16 of the high speed rotary snow producing and throwing apparatus 5 is rotated at high speed by the rotating shaft 9 being driven by a motor 11 provided separately of which the frequency is variable. The rotational speed of the rotor blade 16 is as high as 1800 r.p.m. to 3600 r.p.m. The rotational speed of a rotor blade of a prior art snow throwing apparatus is 1800 r.p.m at most. Compared with this, the rotational speed of the rotor blade 16 in the present invention is extremely high, as high as 1800 r.p.m. to 3600 r.p.m. Therefore, the rotor blade 16 functions like a turbine and sends the forced blast supplied from the supply port 6 out into the snow throwing hose 10 at further increased speed. Moreover, the rotation of the rotor blade 16 at high speed and the supply of the forced blast together from the supply port 6 combine to eliminate even the adhesion of flaky pieces of ice to beating portions of the blades 17 of the rotor blade 16, thereby never causing an excess current in the drive motor of the rotor blade 16.

As shown in FIG. 4, in the high speed rotary snow producing and throwing apparatus 5, the rotating shaft 9 is rotatably supported by bearings 19 on a base 15 and rotationally driven by the motor 11 disposed above the bearings 19 via a belt 20. The rotational speed of motor 11 is changed by frequency conversion, for example, in an inverter method. The tip of the rotating shaft 9 is disposed inside the rotor blade casing 8 overhanging from the bearing 19, and the conical cover 18 is attached to the tip of the rotating shaft 9. For example, six blades 17 the tip side portions of which are tapered off to the root are provided at even intervals around the conical cover 18 to form the rotor blade 16. A flat surface of each blade 17 is nearly orthogonal in relation to the direction of rotation.

The rotor blade casing 8 is cylindrical with size large enough for the rotation of the rotor blade 16 at high speed. One side wall 20 thereof is on the side of the bearings, and the other side wall 21 thereof is composed of a lid 14. The lid 14 is fastened to bolt holes 23 of a flange 22 of the rotor blade casing 8 with bolts 24. The supply port 6 from which the primarily crushed flaky or platy pieces of ice are supplied into the rotor blade casing 8 by the forced blast is provided at the center of the lid 14 over the conical cover 18. In the vicinity of the root of the conical cover 18 and the blades 17 of the rotor blade 16, spaces are left between the conical cover 18 and the blades 17 to form a void portion 27 as shown in FIG. 4, whereby the pieces of ice supplied from the supply port 6 can easily enter the rotor blade casing 8, and further easily enter respective spaces between the blades 17 of the rotor blade 16 by being divided among the blades 17 and by further being guided towards the beating portions by a conical portion on a sloped surface of the conical cover 18. Then, the pieces of ice are secondarily crushed by being rotated while being beaten by the beating portions of the blades 17 rotating at high speed, thereby producing micro crushing ice snow with a particle size of 0.3 mm. The particle size of the secondarily crushed artificial snow is so small that pieces of ice mutually get into spaces among them, thereby producing extremely firm snow.

As shown in FIG. 3, the delivery port 7 is formed with one end thereof extending along a tangent of a cylinder of the outer periphery of the rotor blade casing 8. The artificial snow 13 which is produced after being secondarily crushed by the aforesaid rotor blade 16 rotating at high speed is sent to the snow throwing hose 10 linked to the delivery port 7 via a flange 25 with bolts 26 by the forced blast and the centrifugal force given from the rotor blade 16, and thrown to a skiing slope from the tip of the snow throwing hose 10. The snow throwing hose 10 is 100 m to 200 m in length.

Figure 5:
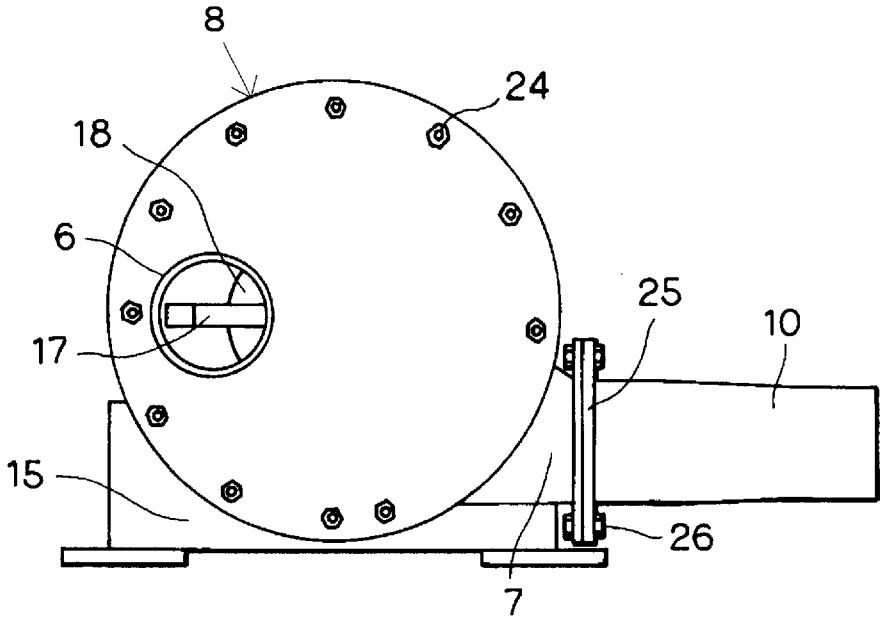
FIG. 5 is a front view of a high speed rotary snow producing and throwing apparatus according to another embodiment of the present invention.
Figure 6:
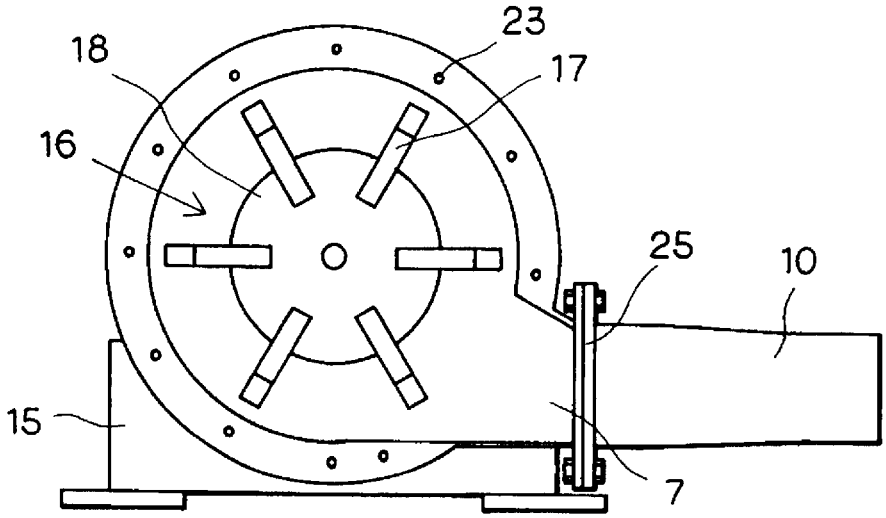
FIG. 6 is a view showing a rotor blade with a lid of a rotor blade casing of the high speed rotary snow producing and throwing apparatus shown in FIG. 5 being taken off.
Figure 7:
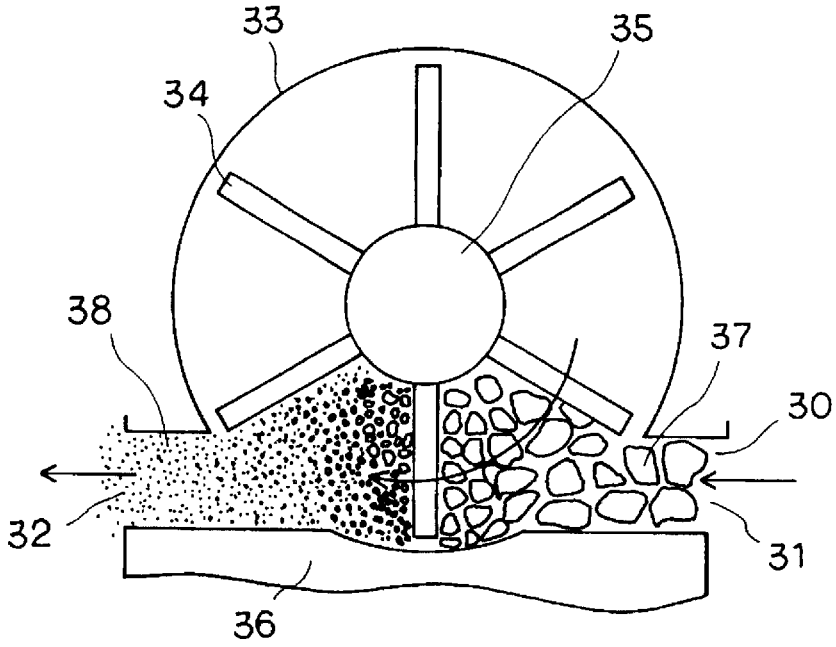
FIG. 7 PRIOR ART
FIG. 7 is a view schematically explaining a prior snow producing apparatus.
Figure 8:
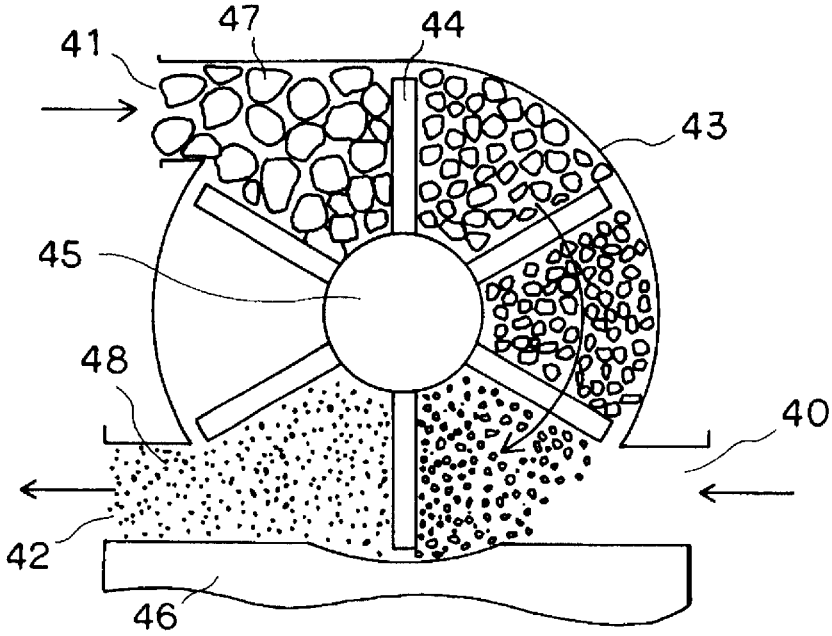
FIG. 8 is a view schematically explaining another prior snow producing apparatus.

FIG. 5 and FIG. 6 are views showing another embodiment of a high speed rotary snow producing and throwing apparatus 5 according to the present invention. This high speed rotary snow producing and throwing apparatus 5 is not different from the previously explained high speed rotary snow producing and throwing apparatus 5 except the position of the supply port 6 for the primarily crushed flaky or platy pieces of ice disposed in the lid 14. Specifically, in this embodiment, as shown in FIG. 5, the supply port 6 is provided at a position offset from the center of the lid 14 which is the other side wall 21 of the rotor blade casing 8. In this embodiment, the supply port 6 is offset leftward (to the side opposite to the delivery port 7) as shown in FIG. 5. However, it can be offset upward or rightward in other examples as long as the port 6 is partially over the conical cover 18. These positions are not illustrated. The snow producing efficiency and size of snow in secondary crushing can be modified by changing the offset position of the supply port 6 as described above. When the supply port 6 is provided at this offset position as shown in FIG. 5, pieces of ice are directly thrown into a space between the blades 17 of the rotor blade 16, and thus immediately beaten by the rotor blade 16. As a result, the crushing efficiency of the secondary crushing is higher as compared with the aforesaid embodiment as shown in FIGS. 2 through 4 in which the supply port 6 is provided at the center of the shaft of the rotor blade.

The rotational speed of the rotor blade rotating at high speed in the aforesaid apparatus of the present invention can be changed within the range of 1800 r.p.m. to 3600 r.p.m by converting the frequency of the motor 11 within the range of 30 Hz to 60 Hz by means of an inverter. The snow producing capacity of the apparatus of the present invention is from 50 tons(t) per day to 600 tons (t) per day. The discharge pressure of the blower for the forced blast used for the apparatus is from 0.12 kgf/cm$^2$ to 0.40 kgf/cm$^2$, and the quantity of snow to be thrown is from 2.0 t/hr to 25 t/hr. The area necessary for the installation of the apparatus of the present invention is from 64 m$^2$ to 180 m$^2$.

As explained above, the high speed rotary snow producing and throwing apparatus of the present invention can produce an excellent effect which can not be obtained in prior arts. For example, primarily crushed flaky or platy pieces of ice are supplied from the inlet of the apparatus into the rotary blade casing of the apparatus by strong discharge pressure of the forced blast and crushed into pieces with smaller and finer particle size through second crushing by the rotor blade rotating at high speed, thereby producing firm artificial snow of good quality, and further enhancing snow throwing capacity by increasing the speed of the forced blast by the turbine function of the rotor blade rotating at high speed, and efficiently letting a large quantity of snow fall onto a skiing slope with a large area by means of the hose with a length as long as 100 m to 200 m without causing an excess current to the drive motor.

The aforesaid embodiment has the intention of clarifying technical meaning of the present invention. Therefore, the present invention is not intended to be limited to the above concrete embodiment and to be interpreted in a narrow sense, and various changes may be made therein without departing from the spirit of the present invention and within the meaning of the claims.

What is claimed is:

1. An apparatus for producing artificial snow from primarily crushed ice, comprising:

a rotatable shaft;

a predetermined number of blades located on one end of said shaft, each of said crushing blades having a beating portion;

an ice input port for inputting the primarily crushed ice towards said blades in a direction that is substantially parallel to said rotatable shaft; and an input ice guide located on said shaft having a conical shape portion with an apex facing said ice input port for receiving the primarily crushed ice from said ice input port and for guiding the primarily crushed ice towards said beating portion of said blades, said conical shape portion and said blades integrally forming an ice receiving area.

2. The apparatus for producing artificial snow according to claim 1 wherein said blades are radially placed on said conical ice guide at an equidistant interval between said blades.

3. The apparatus for producing artificial snow according to claim 1 wherein said blades each have a proximal portion near said shaft and a peripheral portion, said peripheral portion being wider than said proximal portion.

4. The apparatus for producing artificial snow according to claim 1 wherein said ice input port is located substantially concentric with said rotatable shaft.

5. The apparatus for producing artificial snow according to claim 1 wherein said ice input port is located off centric with said rotatable shaft and in an area over and between said proximal end and said distal end.

6. The apparatus for producing artificial snow according to claim 1 wherein said rotatable shaft rotates at a rotational speed ranging from 1800 r.p.m to 3600 r.p.m.

7. The apparatus for producing artificial snow according to claim 1 further comprising a rotary blower for inputting through said ice input port the primarily crushed ice at a pressure ranging from 0.12 kgf/cm$^2$ to 0.40 kgf/cm$^2$.

8. An apparatus for producing artificial snow from primarily crushed ice, comprising:

a rotatable shaft;

a conical ice guide fixedly engaged on one end of said shaft;

a predetermined number of blades located on said conical ice guide for crushing the primarily crushed ice, each of said crushing blades having a beating portion; and an ice input port for inputting the primarily crushed ice towards said conical ice guide and said proximal end of said blades in a direction that is substantially parallel to said rotatable shaft, wherein said conical ice guide receives the primarily crushed ice from said ice input port and guides the primarily crushed ice towards said beating portion of said blades.

9. A method of producing artificial snow from primarily crushed ice using a predetermined number of blades arranged radially about a rotatable shaft, each of the blades having a beating portion, comprising the acts of:

rotating the radially arranged blades on a conical structure via the rotatable shaft;

inputting the primarily crushed ice towards the conical structure in a direction parallel to the rotatable shaft;

guiding the primarily crushed ice via the conical structure towards the beating portion of the radially arranged blades; and crushing the primarily crushed ice substantially at the beating portion while the radially arranged blades are being rotated.

10. The method of producing artificial snow according to claim 9 wherein the primarily crushed ice is guided to the beating portion by a rotatable conical structure located at a center of the radially arranged blades.

11. The method of producing artificial snow according to claim 9 wherein the primarily crushed ice is inputted towards a center of the radially arranged blades.

12. The method of producing artificial snow according to claim 9 wherein the primarily crushed ice is inputted towards an off-center area of the radially arranged blades.

13. The method of producing artificial snow according to claim 9 wherein said rotatable shaft rotates at a rotational speed ranging from 1800 r.p.m to 3600 r.p.m.

14. The method of producing artificial snow according to claim 9 wherein the ice is inputted at a pressure ranging from 0.12 kgf/cm$^2$ to 0.40 kgf/cm$^2$ by a rotary blower.

* * * * *